US005171426A

United States Patent [19]

Mead et al.

[11] Patent Number: 5,171,426

[45] Date of Patent: * Dec. 15, 1992

[54] CONTROL METHOD FOR SOLVENT REFINING LUBRICATING OILS

[75] Inventors: Theodore C. Mead, Port Neches; William H. Stein, Orange, both of Tex.

[73] Assignee: Texaco Inc., White Plains, N.Y.

[ * ] Notice: The portion of the term of this patent subsequent to Aug. 13, 2009 has been disclaimed.

[21] Appl. No.: 678,087

[22] Filed: Apr. 1, 1991

[51] Int. Cl.[5] ..... C10G 53/06

[52] U.S. Cl. ..... 208/322; 208/323; 208/339

[58] Field of Search ..... 208/312, 322, 323, 339

[56] References Cited

U.S. PATENT DOCUMENTS 2,261,287 11/1941 Read ..... 208/312
4,053,744 10/1977 Woodle ..... 208/33
4,311,583 1/1982 Woodle ..... 208/312
4,328,092 5/1982 Sequeira, Jr. ..... 208/326
4,419,226 12/1983 Asselin ..... 208/322
4,866,632 9/1989 Mead et al. ..... 208/87
5,039,399 8/1991 Sequeira, Jr. ..... 208/322

*Primary Examiner*—Theodore Morris
*Assistant Examiner*—David M. Brunsman
*Attorney, Agent, or Firm*—Jack H. Park; Kenneth R. Priem; Richard A. Morgan

[57] ABSTRACT

In a solvent refining process a lubricating oil stock is solvent extracted to yield a primary aromatics-lean raffinate and a primary aromatics-rich extract. Aromatics content of primary raffinate is controlled by manipulating extraction temperature and solvent dosage. Primary extract is separated (settled) to form a secondary raffinate and a secondary extract. The aromatics content of secondary extract is controlled by manipulating settling temperature.

7 Claims, 3 Drawing Sheets

● - WD - 7 @ 180°F
× - WD - 20 @ 140°F
△ - WD - 20 @ 180°F
□ - WD - 50 @ 180°F
○ - WD - 40 @ 180°F

CONTROL METHOD FOR SOLVENT REFINING LUBRICATING OILS

BACKGROUND OF THE INVENTION

1. Field of the Invention

The invention relates to a control method for a solvent refining process. More particularly, the invention relates to solvent refining petroleum derived lubricating oil stocks to yield aromatics-lean raffinates and aromatics-rich extracts. Most particularly the invention relates to simultaneous control of both raffinate and extract quality.

2. Description of the Related Arts

It is well-known in the art to upgrade lubricating oil stocks. Upgrading typically involves treating these stocks with selective solvents to separate a relatively more aromatic fraction from a relatively more paraffinic fraction. In such a treatment, the preferred configuration comprises a countercurrent extraction process in which the lighter lubricating oil phase is introduced into the center or bottom section of the countercurrent extraction tower. The oil phase flows upwardly through the extraction tower and contacts downwardly flowing solvent which is introduced into the upper section of the extraction tower. A relatively paraffinic fraction, termed raffinate, is recovered from the top section of the extraction tower while solvent and relatively aromatic fraction, termed extract, is recovered from the bottom section of the tower.

Extract is used commercially as a rubber extender and processing oil. Nonaromatic content is the primary measurement of quality.

Multistage solvent extraction processes are also known wherein either the raffinate phase, the extract phase or both are subjected to repeated extraction to enhance a desired property.

U.S. Pat. No. 4,866,632 to T. C. Mead et al. teaches a control means and method for a solvent refining processing unit. An algorithm and control system are provided for optimizing the flow of charge oil to provide the maximum yield of extracted oil of a specified quality, measured by refractive index. The invention is based on the discovery that when a charge oil is refined to yield a raffinate of given refractive index, the raffinate viscosity will be the same regardless of the refining temperature and solvent dosage.

U.S. Pat. No. 4,053,744 to R. A. Woodle teaches a control means for a solvent refining unit. The temperature of the extract mix in the solvent refining tower, the flow rate of the charge oil, the flow rate of the solvent and the flow rate of the extract oil are sensed and corresponding signals provided. The control means is operated in accordance with the signals to achieve either a maximum allowable flow rate for the solvent; a maximum allowable flow rate for the extract oil; a maximum allowable flow rate for the refined oil or a reduced charge oil flow rate for a fixed refined oil flow rate.

U.S. Pat. No. 4,328,092 to A. Sequeira, Jr. teaches a process for the solvent extraction of hydrocarbon oils. In the process N-methyl-2-pyrrolidone is the extraction solvent. The hydrocarbon oil is solvent extracted to form two phases, a secondary extract phase and a secondary raffinate phase. The secondary raffinate phase is returned to the extraction zone. As a result, an increased yield of refined oil product and a savings in energy is achieved.

U.S. Pat. No. 4,304,660 to A. Sequeira, Jr. discloses lubricating oils suitable for use as refrigeration oils. Those lubricating oils are produced by solvent extraction of naphthenic lubricating oil base stocks to yield an extract which is mixed with a solvent modifier and cooled to form a secondary raffinate and secondary extract. The secondary raffinate is treated with concentrated sulfuric acid and caustic neutralized to produce the refrigeration oil.

SUMMARY OF THE INVENTION

A control method has been discovered for solvent refining a hydrocarbon lubricating oil stock containing aromatic and non-aromatic components. The lubricating oil stock is contacted in an extraction zone with an extraction solvent in a solvent/oil dosage in the range of 75 vol. % to 500 vol. % at an extraction temperature in the range of 100° F. to 250° F. An aromatics-rich primary extract and an aromatics-lean primary raffinate are withdrawn from the extraction zone.

The viscosity of the primary raffinate is sensed and a signal corresponding thereto generated. The extraction temperature and dosage are adjusted in response to the viscosity signal and a viscosity set point signal.

The primary extract is cooled to a settling temperature 10° F. to 120° F. below the extraction temperature. About 0.0 vol. % to 10 vol. % antisolvent is added. As a result, two phases form consisting of a secondary extract phase richer in aromatics and a secondary raffinate phase leaner in aromatics. The secondary extract phase is separated. The nonaromatics concentration is sensed and a signal corresponding thereto provided. The settling temperature is controlled in accordance with the sensed nonaromatics concentration signal and a nonaromatics set point signal.

By use of the inventive control method, the quality of both the primary raffinate and secondary extract are controlled simultaneously.

DETAILED DESCRIPTION OF THE DRAWINGS

Figure 1:
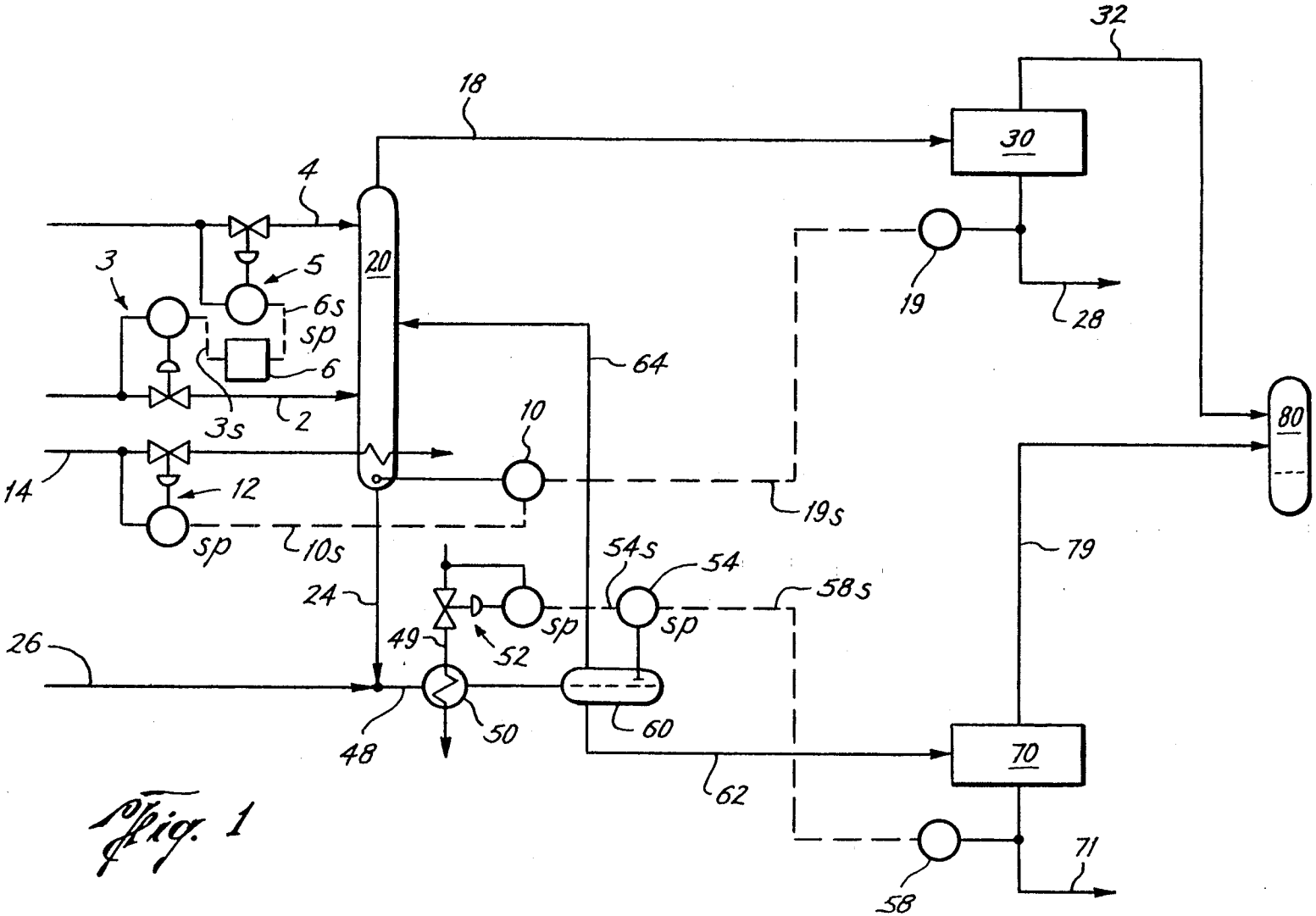
FIG. 1 is a simplified diagram of a control system for controlling a solvent refining process.

With reference to FIG. 1, a lubricating oil feedstock enters the system through line 2. The flow rate of feedstock is controlled by flow control means 3 comprising a flow control valve, flow indicator and controller. Flow control means 3 provides signal 3*s* corresponding to the flow rate of feedstock. The feedstock enters the primary extraction tower 20 at about the middle or below the middle of the tower. Extraction solvent is brought into the process through line 4 and enters the upper portion of primary extraction tower 20. The flow rate of extraction solvent is controlled by flow control means 5 comprising a flow control valve, flow indicator and controller. Signal 3*s* is provided to ratio control means 6. Ratio control means 6 provides set point signal 6*s* to flow control means 5 proportional to the flow of feedstock through line 2.

Extraction solvent enters the upper portion of primary extraction tower 20. Extraction solvent comprises the sum of fresh solvent and recycled solvent. Recycled solvent may be brought into primary extraction tower 20 from solvent accumulator 110 after water removal (not shown) in accordance with maintaining solvent inventory balance.

In the primary extraction tower 20, the lubricating oil feedstock is intimately contacted countercurrently with an extraction solvent which has a preferential affinity for aromatic compounds compared to paraffinic compounds. An example of such a solvent is N-methyl-2-pyrrolidone which is used in the commercial petroleum refining industry for this purpose. As stated, extraction solvent is added in an amount relative to the flow rate of lubricating oil feedstock. On a percentage basis about 75 vol. % to 500 vol. % solvent is added relative to the lubricating oil feedstock, with a dosage in the range of 100 vol. % to 300 vol. % being typical. Extraction temperature is broadly in the range of 100° F. to 250° F. and pressure in the range of 0.5 atm to 10 atm.

Extraction temperature sensed at the junction of extraction tower 20 with line 24 is measured by temperature control means 10 comprising a temperature sensor, temperature indicator and controller. Temperature control means 10 provides set point signal 10*s* to flow control means 12 comprising a flow control valve, flow indicator and controller. Flow control means 12 controls the flow of cooling water or other temperature moderating medium through line 14 to extraction tower 20 to maintain extraction temperature in the range of 100° F. to 250° F. by indirect heat exchange.

As a result of the countercurrent contacting at solvent extraction temperatures and pressures, an aromatics-lean primary raffinate is passed from the top portion of primary extraction tower 20 through line 18 to primary raffinate recovery system 30. Primary raffinate recovery system 30 comprises any of the processes to remove raffinate from residual solvent. This may include, for example, distillation wherein a solvent free raffinate is recovered as a bottoms product and passed via line 28 to tankage. The overhead product of distillation is passed via line 32 to solvent accumulator 80. Primary raffinate recovery system 30 may alternatively be a second extraction stage wherein the primary raffinate is extracted with a second extraction solvent which is only slightly soluble in mineral oils and which is preferentially selective for the primary solvent as compared to the mineral oil. Such a solvent removal process is described in U.S. Pat. No. 2,261,799 to J. L. Franklin, Jr. incorporated herein by reference.

Raffinate quality is typically defined as the concentration of nonaromatics in the stream. Raffinate quality is implicitly measured by refractive index or viscosity index. Refractive index is measured by analysis control means 19 comprising a refractive index analyzer in line 28 and controller. In industrial practice this may be an on-line analyzer capable of providing an electronic set point signal 19*s* as a set point signal to temperature control means 10 In the alternative, analysis control means 19 may be a laboratory analyzer. In this case, signal 19*s* is provided by an operating technician based on the refractive index or viscosity index measurement on the laboratory analyzer.

The combination of analysis control means 19, temperature control means 10 and flow control means 12 provides for maintaining a desired raffinate quality by manipulating extraction temperature. The solvent dosage is held constant by flow control means 3, flow control means 5 and ratio control means 6.

Figure 2:
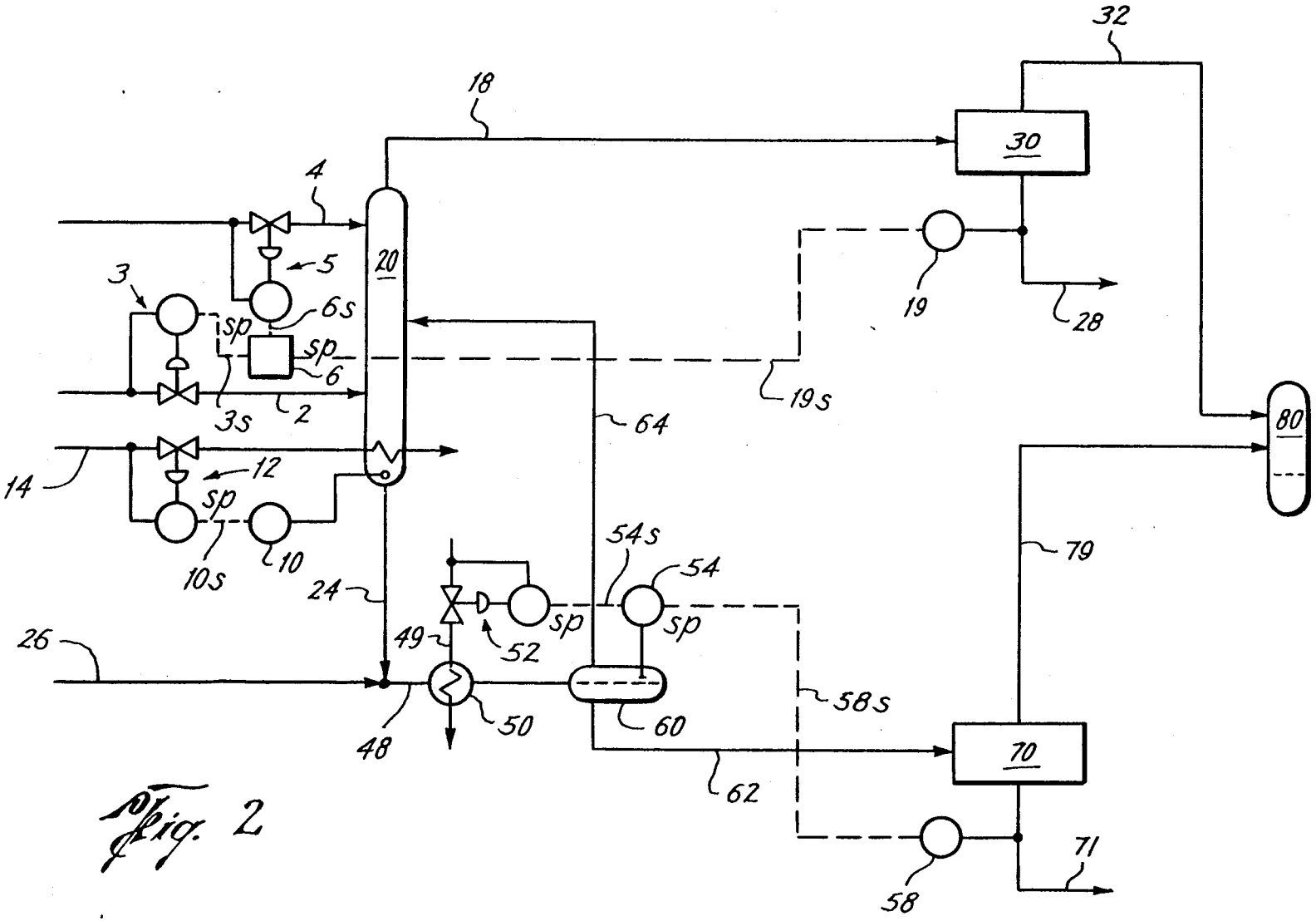
FIG. 2 is a simplified diagram of an alternate control system for controlling a solvent refining process.

An alternative means of controlling raffinate quality is shown in FIG. 2. In this configuration, the solvent dosage is manipulated to maintain raffinate quality while extraction temperature is held constant. Analysis control means 19 provides set point signal 19*s* to ratio control means 6. The flow rate of lubricating oil feedstock is measured by flow control means 3 and signal 3*s* corresponding thereto is provided to ratio control means 6. Based on feedstock flow rate signal 3*s* and analysis control means 19 set point signal 19*s*, ratio control means 6 provides set point signal 6*s* to flow control means 5 which controls the flow rate of extraction solvent into primary extraction tower 20.

The extraction temperature is maintained at a constant value by temperature control means 10 providing set point signal 10*s* to flow control means 12.

Reference is now made to both FIG. 1 and FIG. 2. An aromatics-rich primary extract in solution with extraction solvent is passed from the bottom of primary extraction tower 20 through line 24 and line 48 to primary extract cooler 50. Simultaneously, antisolvent such as water or wet extraction solvent is passed in an amount of 0.0 vol. % to 10 vol. %, preferably 0.5 vol. % to 10 vol. % through line 26 and also line 48 through primary extract cooler 50. Solvent accumulator 80 is a source of wet solvent. Both streams are cooled by means of indirect heat exchange in cooler 50 to a temperature that is 10° F. to 120° F. below the temperature in primary extraction tower 20. The streams are passed together to decanter 60 where two phases spontaneously form. The upper phase is a secondary raffinate phase which is leaner in aromatics than the primary extract. The lower phase is a secondary extract phase which is richer in aromatics than primary extract and comprises a major proportion of the solvent.

The lower secondary extract phase is passed from decanter 60 through line 62 to extract recovery system 70 which comprises means for separating the aromatics-rich extract from extraction solvent. This separation means comprises vacuum flash towers and a stripper. A solvent free secondary extract is passed through line 71 to tankage for use consistent with its aromaticity. The solvent from the extract recovery system 70 is passed through line 79 to solvent accumulator 80 for retention and reuse in the process.

Secondary raffinate phase is optionally passed through line 64 to the primary extraction tower. As described in U.S. Pat. No. 4,328,092 to A. Sequeira, Jr., the preferred amount is 0.1 to 0.5 volumes of secondary raffinate for each volume of lubricating oil stock supplied to the primary extraction tower via line 2. As a result of this recycle the fresh feed supplied to primary extraction tower 20 through line 8 or the solvent dosage may be reduced to the lower quantities in the specified range and the yield of a raffinate produced via line 28 is increased at constant refractive index. In the absence of secondary raffinate recycle, yield is increased by lowering extraction temperature and raising solvent dosage.

The control of cooling medium passed via line 49 to primary extract cooler is critical in controlling extract quality. Extract quality is typically defined as the concentration of nonaromatics. The flow rate of cooling medium in line 49 is controlled by flow control means 52 comprising a flow control valve, flow indicator and controller. Temperature control means 54 comprising a temperature sensor, temperature indicator and controller, provides a signal 54*s* proportional to the difference between the actual temperature and a set point signal.

The set point signal 58s is provided by analysis control means 58, comprising means for analyzing the concentration of nonaromatics in extract in line 71 and providing a corresponding signal and a controller for transmitting set point signal 58s to temperature control means 54. The set point signal 58s is proportional to the difference between the measured nonaromatics concentration and a desired (set point) value.

Analysis control means 58 may be an on-line analyzer which in combination with an electronic controller provides set point signal 58s. In the alternative, analysis control means 58 may be a laboratory analyzer, the results from which are provided to an electronic or pneumatic controller to provide set point signal 58s.

The control system comprising analysis control means 58, temperature control means 54 and flow control means 52 provide for controlling the quality of extract at a desired value.

DESCRIPTION OF THE PREFERRED EMBODIMENTS

Applicants have discovered that a solvent refining process can be controlled to maintain the quality of both refined raffinate and extract simultaneously. A theoretical basis for this discovery has been derived. The derivation comes from the finding that within the commercially known operating range of a solvent refining process, the refractive index of a lubricating oil feedstock, refined raffinate and refined extract all correlate well with the concentration of nonaromatics. Refractive index is distributive for lubricating oil feedstocks within the operating range of the process. It follows that the weighted average refractive index of refined raffinate and extract equals the refractive index of the lubricating oil feedstock. This relationship is used to calculate the yield of refined oil from a feedstock.

$$(100)RIf=(Y)RIr+(100-Y)RIe \quad (1)$$

wherein

Y=yield

RIf=feedstock refractive index

RIr=raffinate refractive index

RIe=extract refractive index

The feedstock refractive index (RIf) remains relatively constant in the time domain compared to the other two refractive indexes. The raffinate refractive index (RIr) which will produce a raffinate of desired quality is easily determined. Equation 1 is rearranged:

$$RIe=100\,(RIf-(Y)RIf)/(100-Y) \quad (2)$$

Equation 2 shows that for a given charge stock refractive indexes of raffinate and extract are a function of yield alone. As stated, refractive index correlates well with the concentration of nonaromatics in raffinate. If the feedstock refractive index is 1.4500 at 70° C. and the required quality of refined raffinate calls for a refractive index of 1.4000, the following refractive indexes of refined extract are calculated.

| Refined Raffinate Yield, % | Extract Refractive Index @ 70° C. |
|---|---|
| 30 | 1.4714 |
| 40 | 1.4833 |
| 50 | 1.5000 |
| 60 | 1.5250 |
| 70 | 1.5667 |
| 80 | 1.6500 |

-continued

| Refined Raffinate Yield, % | Extract Refractive Index @ 70° C. |
|---|---|
| 90 | 1.9000 |

Refractive index is directly related to nonaromatic concentration. It is apparent that raffinate quality (refractive index) can be maintained by controlling the selectivity of the solvent refining process by manipulating extraction temperature and solvent dosage. Extract quality is independent of raffinate quality.

Extract Quality

The quality of extracts is defined as the concentration of nonaromatics. The nonaromatic concentration of secondary extracts is a function of settling temperature which is the temperature at which primary extract is separated into secondary raffinate and secondary extract. Lower settling temperatures produce secondary extracts with lower nonaromatic concentrations.

Figure 3:
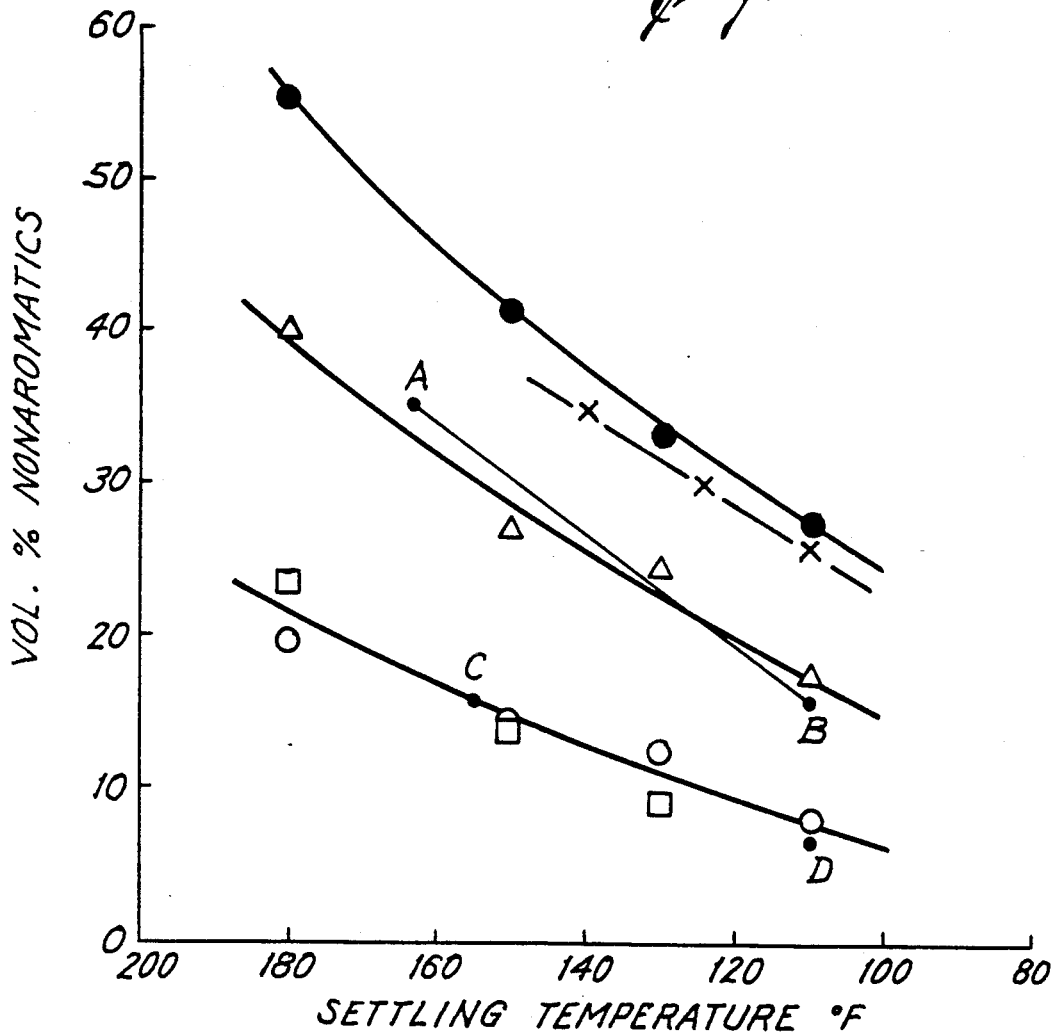
FIG. 3 is a graph of data of settling temperature of secondary extract vs. concentration of nonaromatics, described in the Example.

FIG. 3 is a plot of data demonstrating the influence of settling temperature on the nonaromatic content of secondary extracts. Five different primary extracts derived from paraffinic lubricating oil stocks were separated into secondary raffinate and secondary extract. For each primary extract the separation was made at four settling temperatures; 110° F., 130° F., 150° F. and 180° F. No antisolvent was added. At each settling temperature, the concentration of nonaromatics in extract was measured by ASTM D-2007. The resulting data is plotted on FIG. 3 and a line best fitting the data points drawn for each stock.

Three primary extracts from naphthenic lubricating oil stocks were also subjected to settling. The primary extract derived from the first naphthenic stock was settled at two temperatures and the data plotted as line A-B. Data from the second and third primary extract derived from naphthenic crude is plotted as points C and D.

The data points for the naphthenic feedstocks lie in the same region as those for paraffinic feedstocks which leads to the conclusion that for primary extracts the interrelationship between nonaromatics content and settling temperature is independent of crude source. The quality of secondary extract, however, is dependent on the nonaromatic content of primary extract.

The curves for WD-7, WD-20, WD-40 and WD-50 at 180° F. are nearly linear. The slopes of the lines were plotted against nonaromatic content of 160° F. settling temperature. The result was a straight line of the equation:

$$y=140\,x-11 \quad (3)$$

wherein:

y=the nonaromatic content of a secondary extract settled at 160° F., vol. %.

x=change in nonaromatics/° F., for the secondary extract, vol. %/° F.

The equation is rearranged to the form:

$$x=(y+11)/140. \quad (4)$$

The term y is easily determined experimentally for an secondary extract. It is therefore possible to calculate S(T) the nonaromatic content of a secondary extract at any settling temperature (T) by the equation.

$$S(T)=y-x(160-T) \quad (5)$$

Equation 5 shows that nonaromatic content of secondary extract can be calculated independent of the feedstock type and the conditions of the initial extraction which produced the primary extract and primary raffinate. That is, the quality of secondary extract is independent of the quality of primary raffinate.

EXAMPLE

Data was collected to confirm Equation 5. Primary extracts were separated into secondary extracts by settling at various temperatures in a bench scale test. The experimental results measured by ASTM D-2007, and the results predicted by Equation 5 are recorded in Table 1.

TABLE 1

| Stock (type) | SEL EX SAT % 160° F. | PRIMARY EX TEMP., °F. | SETTLING TEMP., °F. | CALCULATED SAT % | MEASURED SAT % |
|---|---|---|---|---|---|
| WD-7 (Para) | 45.5 | 180 | 180 | 54 | 55 |
| WD-7 (Para) | 45.5 | 180 | 150 | 42 | 42 |
| WD-7 (Para) | 45.5 | 180 | 130 | 33 | 33 |
| WD-7 (Para) | 45.5 | 180 | 110 | 25 | 27 |
| WD-20 (Para) | 41 | 140 | 140 | 34 | 35 |
| WD-20 (Para) | 41 | 140 | 125 | 30 | 30 |
| WD-20 (Para) | 41 | 140 | 110 | 22 | 26 |
| WD-20 (Para) | 32 | 180 | 180 | 38 | 40 |
| WD-20 (Para) | 32 | 180 | 150 | 29 | 27 |
| WD-20 (Para) | 32 | 180 | 130 | 23 | 24 |
| WD-20 (Para) | 32 | 180 | 110 | 7 | 8 |
| WD-40 (Para) | 17 | 180 | 180 | 21 | 20 |
| WD-40 (Para) | 17 | 180 | 150 | 15 | 15 |
| WD-40 (Para) | 17 | 180 | 130 | 11 | 12 |
| WD-40 (Para) | 17 | 180 | 110 | 7 | 8 |
| WD-50 (Para) | 17 | 180 | 180 | 21 | 23 |
| WD-50 (Para) | 17 | 180 | 150 | 15 | 14 |
| WD-50 (Para) | 17 | 180 | 130 | 11 | 10 |
| 100 Pale (Np) | 33.5 | 164 | 164 | 35 | 35 |
| 100 Pale (Np) | 33.5 | 164 | 115 | 19 | 16 |
| 900 Pale (Np) | 17 | 155 | 155 | 16 | 16 |
| 900 Pale (Np) | 17 | 155 | 115 | 8 | 8 |

type - Para - Paraffinic
Np - Naphthenic
SAT % - % nonaromatics
PRIMARY EX TEMP. - Primary extraction temperature
SEL EX SAT % 160° F. - secondary extract, % nonaromatics at 160° F.

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A control method for solvent refining a hydrocarbon lubricating oil stock containing aromatic and nonaromatic components with an extraction solvent wherein said lubricating oil stock is contacted with the extraction solvent at an extraction temperature in the range of 100° F. to 250° F. and a solvent to oil dosage in the range of 75 to 500 vol. % thereby forming an aromatics-rich primary extract and an aromatics-lean primary raffinate of selected viscosity index; the control method comprising:

separating and cooling the primary extract to a settling temperature 10° F. to 120° F. below said extraction temperature thereby forming two phases consisting of a secondary extract phase richer in aromatics and a secondary raffinate phase leaner in aromatics, separating the secondary extract phase, sensing the aromatics concentration in said secondary extract phase and providing a signal corresponding thereto, controlling said settling temperature in accordance with the sensed aromatics concentration signal and a set point signal.

2. A control method for solvent refining a hydrocarbon lubricating oil stock containing aromatic and nonaromatic components comprising:

contacting said lubricating oil stock with an extraction solvent at an extraction temperature in the range of 100° F. to 250° F. and a solvent to oil dosage in the range of 75 to 500 vol. % thereby forming an aromatics-rich primary extract and an aromatics-lean primary raffinate, and separating said primary raffinate, sensing an aromatics-rich quality index and providing a signal corresponding thereto, controlling said extraction temperature and said dosage in accordance with said aromatics-rich quality index signal and an aromatics-rich quality index set point signal, separating and cooling the primary extract to a settling temperature 10° F. to 120° F. below said extraction temperature, thereby forming two phases consisting of a secondary extract phase richer in aromatics and a secondary raffinate phase, leaner in aromatics, separating the secondary extract phase, sensing an aromatics-lean quality index in said secondary extract phase and providing a signal corresponding thereto, controlling said settling temperature in accordance with the sensed aromatics-lean quality index signal and an aromatics-lean quality index set point signal.

3. The control method of claim 2 wherein said aromatics-rich quality index is refractive index.

4. The control method of claim 2 wherein said aromatics-rich quality index is a viscosity index.

5. The control method of claim 2 wherein said aromatics-lean quality index is a refractive index.

6. The control method of claim 2 wherein said aromatics-lean quality index is a viscosity index.

7. A control method for solvent refining a hydrocarbon lubricating oil stock containing aromatic and non-aromatic components with an extraction solvent comprising:

contacting said lubricating oil stock with said extraction solvent at a solvent oil dosage and an extraction temperature thereby forming an aromatics-rich primary extract and an aromatics-lean primary raffinate, separating said primary raffinate, sensing a viscosity index and providing a signal corresponding thereto, controlling said extraction temperature in the range of 100° F. to 250° F. and said solvent to oil dosage in the range of 75 to 500 vol. % responsive to said viscosity index signal and a viscosity index set point signal, separating said primary extract and cooling to a settling temperature 10° F. to 120° F. below said extraction temperature thereby forming two phases consisting of a secondary extract phase richer in aromatics and a secondary raffinate phase leaner in aromatics, separating the secondary extract phase, and sensing the aromatics concentration and providing a signal corresponding thereto, controlling said settling temperature in accordance with the sensed aromatics concentration signal and aromatics set point signal, thereby maintaining quality of both said primary raffinate and said secondary extract.

* * * * *